US007158747B2

(12) United States Patent
Oonishi

(10) Patent No.: US 7,158,747 B2
(45) **Date of Patent: *Jan. 2, 2007**

(54) BELT-TYPE FIXING DEVICE

(75) Inventor: Taizou Oonishi, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/805,221

(22) Filed: Mar. 22, 2004

(65) Prior Publication Data

US 2004/0184847 A1 Sep. 23, 2004

(30) Foreign Application Priority Data

Mar. 20, 2003 (JP) ..... 2003-077074

(51) Int. Cl.
*G03G 15/20* (2006.01)

(52) U.S. Cl. ..... 399/329; 399/400

(58) Field of Classification Search ..... 399/329, 399/328, 333, 400

See application file for complete search history.

(56) References Cited

U.S. PATENT DOCUMENTS

| | | | | |
|---|---|---|---|---|
| 4,146,659 | A * | 3/1979 | Swift et al. | 399/331 |
| 4,375,327 | A * | 3/1983 | Matsumoto et al. | 399/331 |
| 5,471,288 | A * | 11/1995 | Ohtsuka et al. | 399/324 |
| 6,009,300 | A * | 12/1999 | Kagawa et al. | 399/333 |
| 6,535,701 | B1 * | 3/2003 | Baba | 399/328 |
| 6,733,944 | B1 * | 5/2004 | Kadokura et al. | 399/329 |
| 6,795,678 | B1 * | 9/2004 | Yura et al. | 399/329 |
| 6,807,386 | B1 * | 10/2004 | Yasui et al. | 399/329 |
| 6,895,208 | B1 * | 5/2005 | Nakatogawa et al. | 399/329 |
| 2002/0018676 | A1 * | 2/2002 | Hirai et al | 399/329 |
| 2004/0101334 | A1 * | 5/2004 | Tatematsu et al. | 399/329 |
| 2004/0190958 | A1 * | 9/2004 | Matsumoto | 399/329 |
| 2004/0265020 | A1 * | 12/2004 | Aruga | 399/329 |

FOREIGN PATENT DOCUMENTS

| | | | |
|---|---|---|---|
| JP | 3-228076 | | 10/1991 |
| JP | 04273278 | A * | 9/1992 |
| JP | 06118817 | A * | 4/1994 |
| JP | 10-228195 | | 8/1998 |
| JP | 11-133776 | | 5/1999 |
| JP | 2001-356625 | | 12/2001 |
| JP | 2002-148979 | | 5/2002 |

* cited by examiner

*Primary Examiner*—Diego Gutierrez
*Assistant Examiner*—Travis Reis
(74) *Attorney, Agent, or Firm*—Morrison & Foerster LLP

(57) ABSTRACT

A belt-type fixing device is provided by which driving torque for a fixing belt can be reduced.

The belt-type fixing device has the fixing belt wound around a heating roller and around a nip forming member, and has a pressurizing roller that is in pressure contact with the nip forming member with the fixing belt interposed between. A surface of the nip forming member that is opposite to the pressurizing roller is configured as a curved surface extending along an outer circumferential surface of the pressurizing roller so that a pressure distribution in a fixing nip is made generally flat with respect to a paper feeding direction. By rotational drive of the pressurizing roller, the fixing belt is rotated while being slid on the nip forming member. Contact area between the fixing belt and the nip forming member outside the fixing nip is smaller on nip entrance side than on nip exit side.

7 Claims, 4 Drawing Sheets

BELT-TYPE FIXING DEVICE

RELATED APPLICATION

This application is based on Japanese Patent Application No. 2003-77074, the content of which is incorporated herein by reference.

BACKGROUND OF THE INVENTION

The present invention relates to a belt-type fixing device that is used in an electrophotographic image forming apparatus.

In Japanese Patent Laid-Open Publication 2001-356625, a fixing device has been disclosed in which pressure contact of a pressurizing pad with a thermal fixing roller having a heat source therein through an endless belt forms a fixing nip between the thermal fixing roller and the endless belt. In the fixing device, the thermal fixing roller has an elastic layer on an outer circumference thereof, and the elastic layer is pressed by the pressurizing pad through the endless belt so as to be strained. The fixing device is configured so that nip pressures in the fixing nip is larger in vicinity of an exit for a recording sheet.

The fixing device, however, has a problem in that frictional resistance between the endless belt and the pressurizing pad increases a driving torque for the endless belt because the endless belt rotates while sliding on the pressurizing pad.

SUMMARY OF THE INVENTION

A primary object of the present invention is to reduce a driving torque for a belt.

Another object of the invention is to reduce a driving torque for a belt in a belt-type fixing device in which the belt rotates while sliding on a nip forming member by rotational drive of a roller in contact with the belt.

In order to achieve the objects, in an aspect of the invention, there is provided a belt-type fixing device comprising an endless-sheet-like fixing belt to be heated wound around a supporting member and around a nip forming member that is fixed in a position away from the supporting member so as to be incapable of rotating, and a pressurizing roller which can be driven to rotate, which is in pressure contact with the nip forming member with the fixing belt interposed between, and of which part in contact with the fixing belt forms a fixing nip, wherein a surface of the nip forming member that is opposite to the pressurizing roller is configured as a curved surface extending along an outer circumferential surface of the pressurizing roller so that a pressure distribution in the fixing nip is made generally flat with respect to a paper feeding direction, the fixing belt is rotated while being slid on the nip forming member by rotational drive of the pressurizing roller, and contact area between the fixing belt and the nip forming member outside the fixing nip is smaller on an entrance side of the fixing nip than on an exit side of the fixing nip.

In the belt-type fixing device of the invention, preferably, the supporting member is a rotatable heating roller, and an outside diameter of the heating roller is larger than a width of the nip forming member with respect to the paper feeding direction. In this case, the heating roller is preferably in a position lower than the nip forming member, in a configuration in which a recording medium is substantially vertically passed through the fixing nip.

In the belt-type fixing device of the invention, an angle which a pre-fixation guide for guiding introduction of a recording medium into the fixing nip forms with the fixing belt on the entrance side of the fixing nip is preferably in a range from 30° to 70°.

In the belt-type fixing device of the invention, a distance between the pre-fixation guide for guiding introduction of a recording medium into the fixing nip and a line extending in parallel with the pre-fixation guide from a point of contact between the nip forming member and the fixing belt on the entrance side of the fixing nip is preferably 3 mm or larger.

In another aspect of the invention, there is provided a belt-type fixing device for fixing a toner image on a paper, the belt-type fixing device comprising:

an endless-sheet-like belt member wound around a heating roller having a heater and around a nip forming member that is fixed so as to be incapable of rotating, and a pressurizing roller which has an elasticity, which is driven to rotate, which is relatively pressed against the nip forming member through the belt member, and on which the paper is passed through a fixing nip that is contact part between the pressurizing roller and the belt member, wherein a position of the heating roller is on upstream side relative to the nip forming member with respect to a direction in which the paper being passed through the fixing nip is conveyed.

In the belt-type fixing device of another aspect of the invention, a surface of the nip forming member that is opposite to the pressurizing roller may be shaped so as to extend along an outer circumferential surface of the pressurizing roller.

In the belt-type fixing device of the invention, the fixing belt follows the pressurizing roller that is driven to rotate, and thereby rotates concomitantly while sliding on the nip forming member. During the rotation, part of the fixing belt on upstream side of the fixing nip with respect to a rotating direction of the belt makes tight side in which tension is relatively high, and part of the fixing belt on downstream side of the fixing nip makes loose side in which tension is relatively low. Most of the driving torque required for rotating the fixing belt is caused by frictional resistance between the tight part of the fixing belt and the nip forming member on the entrance side of the fixing nip. The belt-type fixing device of the invention is therefore configured so that contact area between the fixing belt and the nip forming member outside the fixing nip is smaller on the nip entrance side than on the nip exit side. Consequently, the driving torque for the fixing belt can be reduced.

In the belt-type fixing device of the invention, recording media can stably be plunged into the fixing nip without occurrence of jam on condition that the angle and the distance concerning the relation between the pre-fixation guide and the fixing belt are set in the appropriate range.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
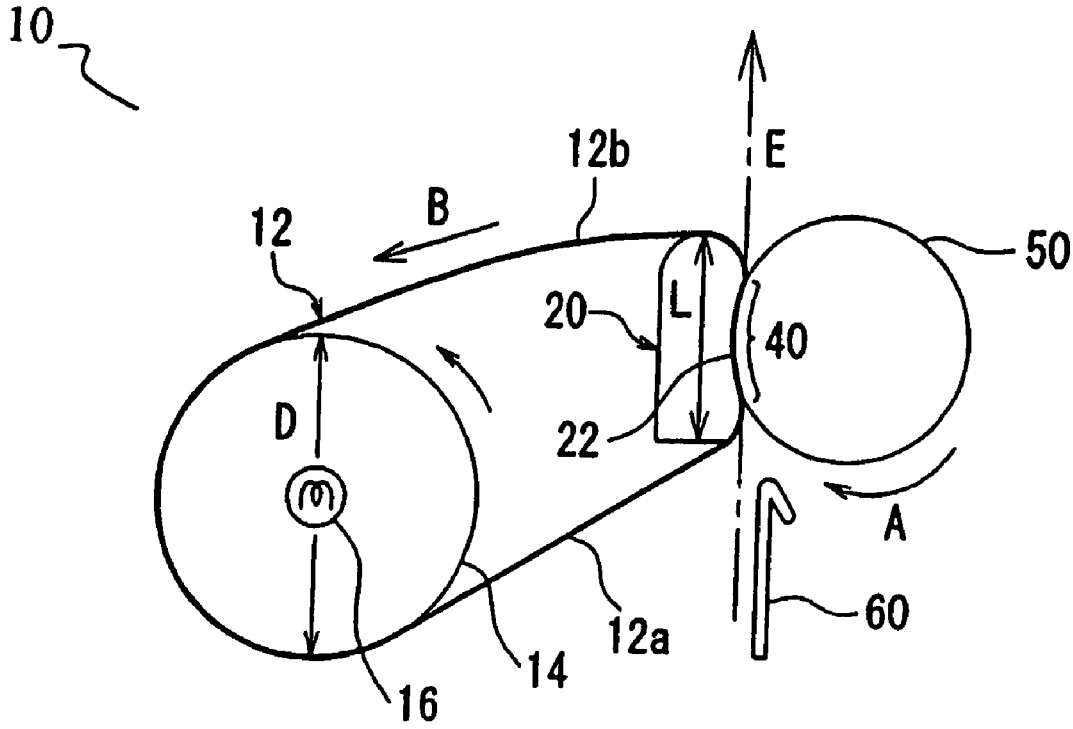
FIG. 1 shows a configuration of a belt-type fixing device.

FIG. 1 shows a belt-type fixing device 10 that is an embodiment of the invention. The belt-type fixing device 10 has an endless-sheet-like fixing belt 12. The fixing belt 12 has an outside diameter of 65 mm in form of a cylinder, for example, and is composed of a 70 μm-thick base material made of polyimide, a 200 μm-thick elastic layer made of silicone rubber, and a 30 μm-thick mold release layer made of PFA (copolymer of tetrafluoroethylene and perfluoroalkyl vinylether), for example, which are superimposed in order of mention from inside.

The fixing belt 12 is wound around a heating roller (a heating member) 14 that is rotatably supported at both ends thereof and around a nip forming member 20 that is fixed in a position away from the heating roller 14 so that the member 20 cannot be rotated. It is to be noted that, in order to reduce frictional resistance between the fixing belt 12 that is rotating and the nip forming member 20, lubricant such as grease and oil may be applied onto an inner surface of the fixing belt 12.

The heating roller 14 is composed of a cylindrical metal tube having an outside diameter D of 35 mm, for example, and has a heater lamp 16 as a heat source therein. The heating roller 14 is biased by a spring not shown in a direction such that the heating roller 14 goes away from the nip forming member 20, and a specified tension is thereby imparted to the fixing belt 12.

The fixing belt 12 is heated by the heating roller 14 heated from inside by the heater lamp 16. A thermistor (not shown) is provided so as to be in contact with the heating roller 14. Temperatures of the heating roller 14 and the fixing belt 12 can be set at desired values by on-off control over the heater lamp 16 according to a temperature detected by the thermistor.

The nip forming member 20 is provided inside the fixing belt 12, and a pressurizing roller 50 is in pressure contact with the nip forming member 20, with the fixing belt 12 interposed between. The pressurizing roller 50 is provided in a position generally horizontal with respect to the nip forming member 20. Contact part between the fixing belt 12 and the pressurizing roller 50 forms a fixing nip 40.

The pressurizing roller 50 has an outside diameter of 30 mm, for example, and has a 4 mm-thick elastic layer (not shown) composed of rubber or sponge on an outer circumference of a metal core that is like a metal cylinder. A 40 μm-thick mold release layer (not shown) is formed on a surface of the elastic layer. The pressurizing roller 50 is driven by a motor (not shown) to rotate in a direction of an arrow A. It is to be noted that an auxiliary heater may be provided inside the pressurizing roller 50.

The elastic layer of the pressurizing roller 50 has a length of 240 mm, for example, along an axial direction (a direction of depth in FIG. 1). The fixing belt 12 has a width larger than the length of the elastic layer so that the whole length of the elastic layer of the pressurizing roller 50 is in pressure contact. The nip forming member 20 extends so as to support an overall width of the fixing belt 12.

A nip load in the fixing nip 40 (that is, a contact pressure from the pressurizing roller 50) is set in a range from 160 to 240 N, and then a mean pressure in the fixing nip 40 is in a range not less than 50 kPa and not more than 250 kPa. The mean pressure smaller than 50 kPa prevents stable transmission of a driving force of the pressurizing roller 50 to the fixing belt 12 and the mean pressure larger than 250 kPa only increases a driving load on the fixing belt 12 and thus necessitates a motor having a larger electric power consumption.

The nip forming member 20 is formed of material (such as resin and ceramic) that has a low heat conductivity and that is harder than the elastic layer of the pressurizing roller 50. A surface 22 of the nip forming member 20 that is opposite to the pressurizing roller 50 is configured as a curved surface that extends along an outer circumferential surface of the pressurizing roller 50. Specifically, a radius of curvature of the opposite surface 22 of the nip forming member 20 is equal to a radius of curvature of the outer circumferential surface of the pressurizing roller 50 (e.g., 15 mm) or is a little larger (e.g., 15.4 mm) than that. In such a configuration, a length of the fixing nip 40 with respect to a circumferential direction of the pressurizing roller 50 (that is, a nip width) is about 12 mm. Thus the surface 22 of the nip forming member 20 that is opposite to the pressurizing roller 50 is configured as the curved surface extending along the outer circumferential surface of the pressurizing roller 50, and a pressure distribution in the fixing nip 40 is thereby made generally flat with respect to a paper feeding direction (a direction of an arrow E) Herein, "generally flat" status includes status in which nip pressure in center part of the fixing nip 40 is slightly higher than that at an entrance side and an exit side of the fixing nip 40 and status in which nip pressure at the entrance side and the exit side of the fixing nip 40 is slightly higher than that in the center part in the fixing nip 40.

It is to be noted that on the opposite surface 22 of the nip forming member 20 may be provided an elastic layer composed of rubber, for example. Provided a surface of the nip forming member 20 on which the fixing belt 12 slides has convex part composed of parting lines formed in resin molding, the elastic layer concealing the convex part can prevent increase in a driving torque for the fixing belt 12 which increase is caused by concentrated pressure of the fixing belt 12 against the convex part.

Figure 2:
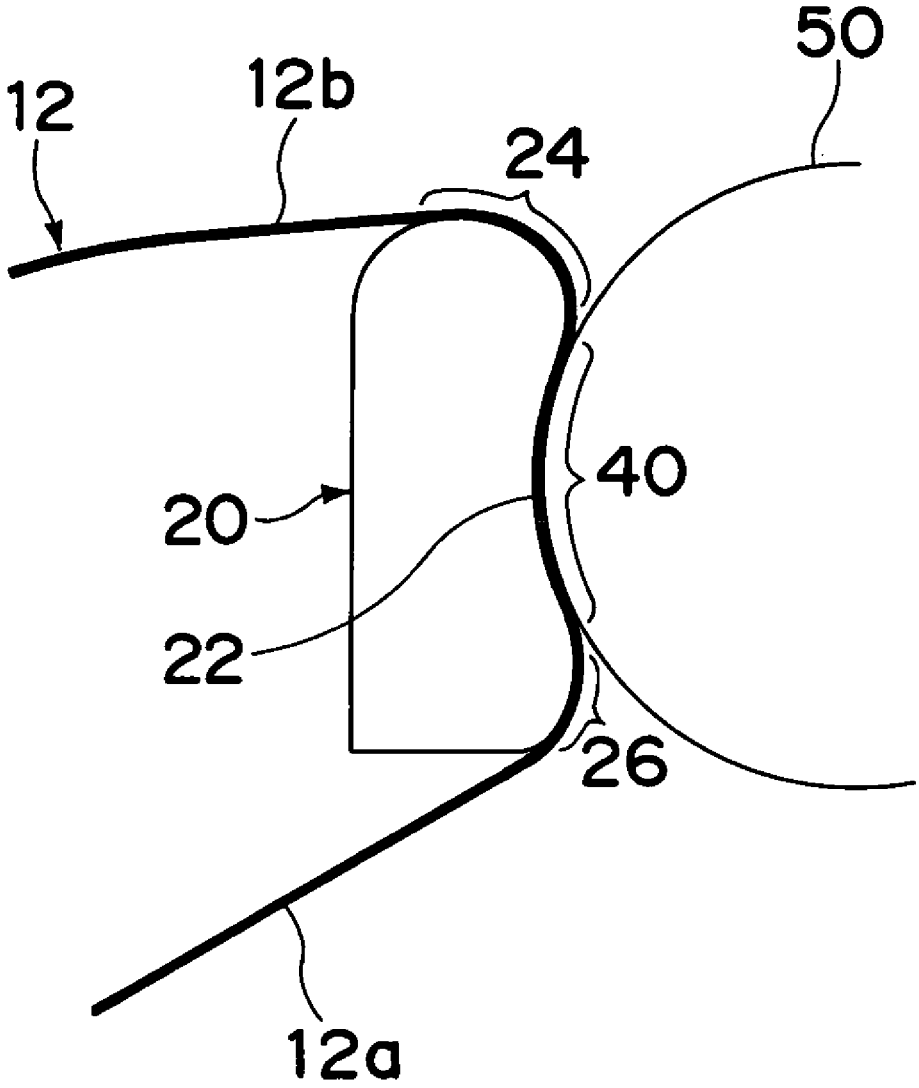
FIG. 2 is an enlarged view of a nip forming member of FIG. 1.

A width L of the nip forming member 20 with respect to the paper feeding direction is 17 mm, for example, and an outside diameter D (35 mm) of the heating roller 14 is set so as to be larger than the width L of the nip forming member 20. In a configuration in which a paper as a recording medium is conveyed through the fixing nip 40 vertically from lower to upper side, as shown in FIG. 1, the pressurizing roller 50 and the nip forming member 20 are positioned horizontally in general with respect to each other, and the heating roller 14 is in a position lower than the nip forming member 20. In other words, the position of the heating roller 14 is on upstream side relative to the nip forming member 20 with respect to the direction in which a paper is conveyed and passed through the fixing nip 40 vertically from lower to upper side. The nip forming member 20 has a shape that is vertically asymmetric. That is, upper part of the nip forming member 20 has a round curved surface that forms a semicircle, whereas lower part thereof has a curved surface narrower than that of the upper part. Thus a relation of size between the nip forming member 20 and the heating roller 14, a relation of vertical position between the nip forming member 20 and the heating roller 14, and a specified shape of the nip forming member 20 are set so that contact area between the fixing belt 12 and the nip forming member 20 outside the fixing nip 40 is smaller in a region 26 on nip entrance side (i.e., below the fixing nip 40) than in a region 24 on nip exit side (i.e., above the fixing nip 40), as shown in FIG. 2.

As long as contact area between the fixing belt 12 and the nip forming member 20 outside the fixing nip 40 is smaller on the nip entrance side than on the nip exit side, the relation of size between the nip forming member 20 and the heating roller 14, the relation of vertical position between the nip forming member 20 and the heating roller 14, and the shape of the nip forming member 20 are not limited to those described above. For example, the nip forming member 20 may be configured in a vertically symmetric shape in which lower part has a semicircular roundness similar to upper part. Such a symmetric shape of the nip forming member 20 has an effect of improving property for assembly.

Under the fixing nip 40 is provided a pre-fixation guide 60, which guides the paper having an unfixed toner image formed on a surface thereof and introduces the paper into the fixing nip 40.

When the pressurizing roller 50 is driven to rotate in the direction of the arrow A, in the belt-type fixing device 10 with the configuration described above, the fixing belt 12 concomitantly moves and rotates in a direction of an arrow B while sliding on the surface of the nip forming member 20. While the fixing belt 12 rotates in such a manner, an overall periphery of the fixing belt 12 is heated by the heating roller 14 and temperatures of the fixing belt 12 thereby rise to a specified fixation temperature (e.g., 180° C.).

After the fixing belt 12 is heated so as to have the specified fixation temperature, the paper having the unfixed toner image formed on the surface thereof is guided by the pre-fixation guide 60 so as to be introduced into the fixing nip 40. Thus the toner image is fixed onto the paper while the paper is passed through the fixing nip 40. The paper having passed through the fixing nip 40 is conveyed upward and is then ejected to outside of the image forming apparatus.

As described above, the pressurizing roller 50 is driven to rotate and then the fixing belt 12 follows the pressurizing roller 50 so as to rotate while sliding on the nip forming member 20. During the rotation, part 12*a* of the fixing belt 12 on upstream side of the fixing nip 40 with respect to the rotating direction of the belt makes tight side in which tension is relatively high, and part 12*b* of the fixing belt 12 on downstream side of the fixing nip 40 makes loose side in which tension is relatively low. Most of the driving torque required for rotating the fixing belt 12 is caused by frictional resistance between the tight part 12*a* of the fixing belt 12 and the nip forming member 20 on the entrance side of the fixing nip 40. The belt-type fixing device 10 of the embodiment is therefore configured so that contact area between the fixing belt 12 and the nip forming member 20 outside the fixing nip 40 is smaller in the region 26 on the nip entrance side than in the region 24 on the nip exit side. Consequently, the driving torque for the fixing belt 12 can be reduced.

In the belt-type fixing device 10 of the embodiment, the surface 22 of the nip forming member 20 that is opposite to the pressurizing roller 50 is configured as the curved surface extending along the outer circumferential surface of the pressurizing roller 50, and the pressure distribution in the fixing nip 40 is thereby made generally flat with respect to the paper feeding direction, so that paper conveying velocities are made uniform throughout the fixing nip 40. Thus stress is prevented from acting on the paper passing through the fixing nip 40, and image noise such as image blur, wrinkles of paper and the like are thereby prevented from occurring.

In the belt-type fixing device 10 of the embodiment, the fixing nip having a desired width can be obtained with adequate setting of a width of the nip forming member 22. Accordingly, the fixing nip 40 having a large width, for example, of 12 mm is easily obtained by a comparatively low nip pressure, in contrast to a conventional fixing device in which a fixing nip is formed between two rollers in pressure contact with each other and which requires a considerably large contact pressure for obtainment of a wide fixing nip. Thus nip time required for fixation is ensured by the wide fixing nip 40, so that increase in system speed of the image forming apparatus can be addressed.

In accordance with the belt-type fixing device 10, the fixing device can be miniaturized and a circumference of the fixing belt 12 can be shortened by substitution of the nip forming member 20 for a fixing roller having an elastic layer on an outer circumference thereof which roller has been used in conventional belt-type fixing devices. Thus the fixing belt 12 can be shortened so that a heat capacity of the fixing belt 12 and heat release from the fixing belt 12 are reduced. Furthermore, substitution of the nip forming member 20, e.g., made of resin with a small heat capacity for a fixing roller having an elastic layer with a large heat capacity increases a rate at which temperatures rise in the fixing belt being heated by the heating roller 14. As a result, warm-up time at a start and recovery time from printing-standby status can be shortened.

On condition that a pressure contact load of the pressurizing roller 50 is variable in accordance with a type of the recording medium in the belt-type fixing device 10 of the embodiment, positions of an entrance and an exit of the fixing nip 40 do not change so much as those in a conventional fixing device in which a fixing nip is formed between two rollers. Therefore, deterioration is prevented in performance on plunge of paper into the fixing nip 40 and performance on separation of paper ejected from the fixing nip 40.

Figure 3:
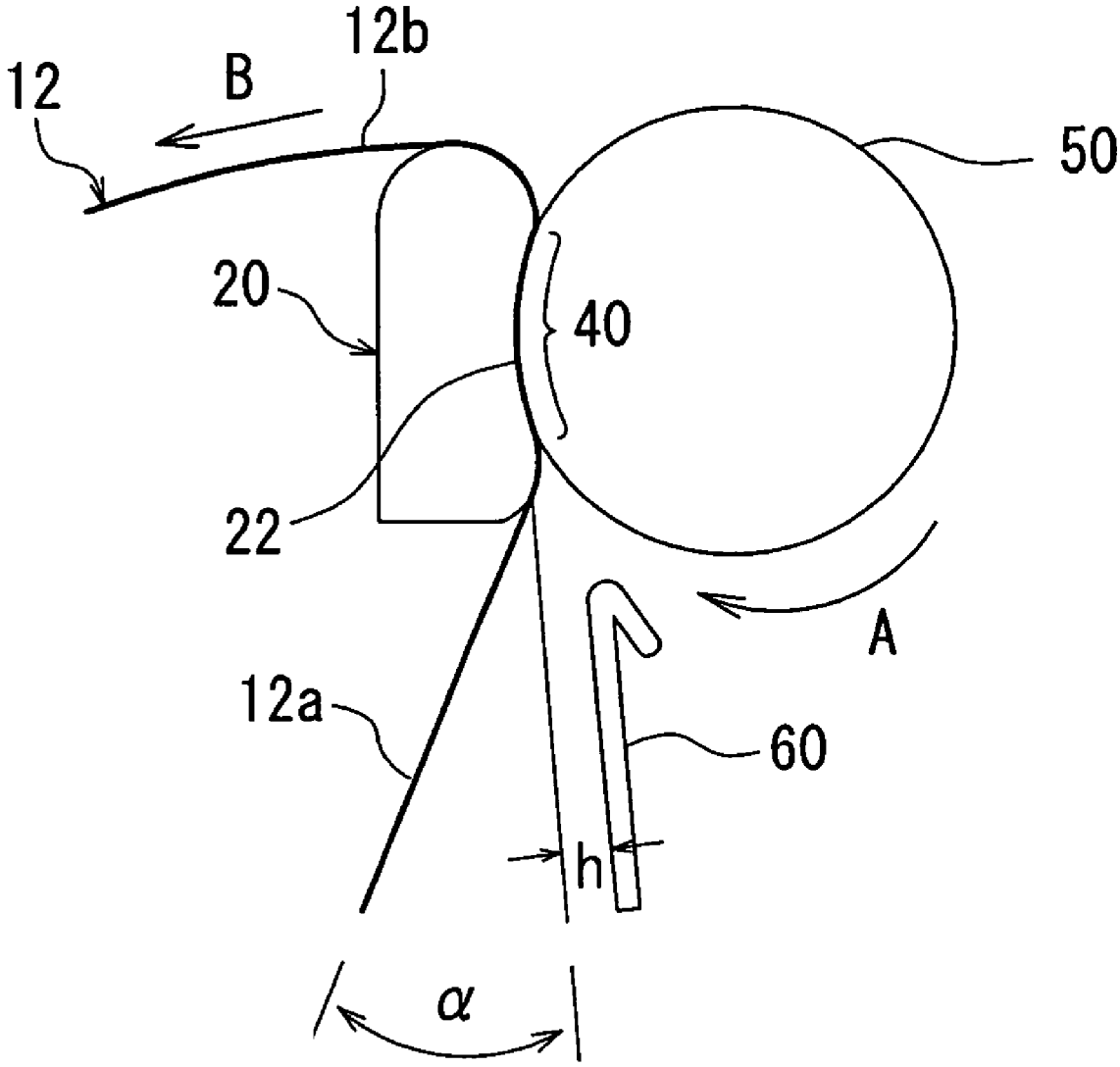
FIG. 3 is a fragmentary enlarged view of the belt-type fixing device of FIG. 1.
Figure 4:
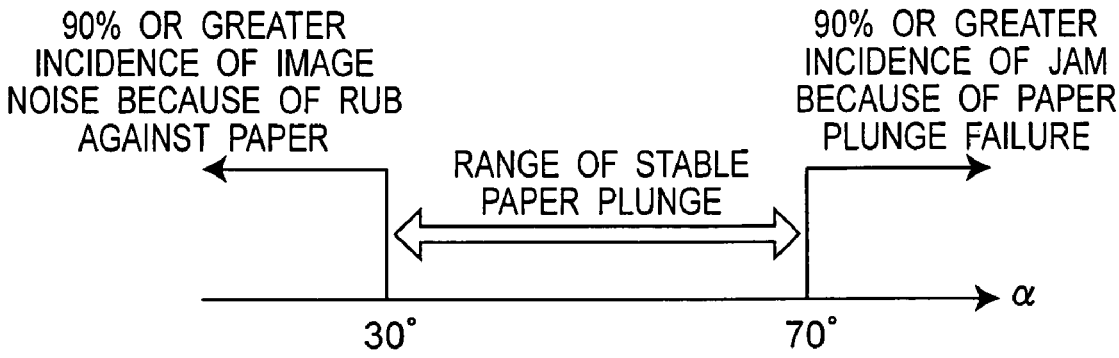
FIG. 4 is a diagram illustrating a result of an examination as to stability of plunge of papers into a fixing nip.

For the belt-type fixing device 10, as shown in FIG. 3, stability of plunge of paper as the recording medium into the fixing nip 40 was examined with change in an angle $\alpha$ which the pre-fixation guide 60 formed with the fixing belt 12 on the entrance side of the fixing nip 40. FIG. 4 shows a result of the examination. With the angle $\alpha$ smaller than 30°, there was an extremely high incidence of image noise caused by rubbing of the paper against the fixing belt 12 prior to the plunge into the fixing nip 40. With the angle $\alpha$ larger than 70°, on the other hand, there was an extremely high incidence of jam caused by failure in the plunge of the paper into the fixing nip 40. The result proved that the paper could stably be plunged into the fixing nip 40 with the angle $\alpha$ set in a range from 30° to 70°.

Figure 5:
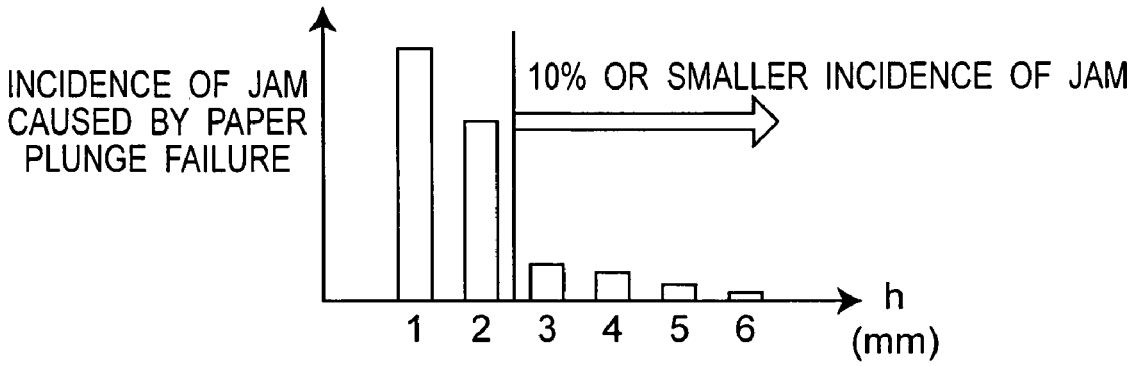
FIG. 5 is a diagram illustrating a result of an examination as to stability of plunge of papers into the fixing nip.

Stability of the plunge of paper into the fixing nip 40 was also examined with change in a distance h between the pre-fixation guide 60 and a line extending in parallel with the pre-fixation guide 60 from a point of contact between the nip forming member 20 and the fixing belt 12 on the entrance side of the fixing nip 40, as shown in FIG. 3. FIG. 5 shows a result of the examination. The distance h smaller than 3 mm resulted in a high incidence of jam caused by failure in the plunge of the paper, whereas the distance h not smaller than 3 mm restricted the incidence of the jam to 10% or smaller. The result proved that the paper could stably be plunged into the fixing nip 40 with the distance h not smaller than 3 mm.

It is to be noted that, in the belt-type fixing device 10, the fixing belt 12 is heated by the heating roller 14 having the heater lamp 16 therein; however, the fixing belt 12 may be heated by a heat source provided in contact with or adjacent to the fixing belt 12 at a location other than that of the heating roller.

Though the rotatable heating roller 14 is used as the heating member in the belt-type fixing device 10, a sheet-like heater that cannot be rotated may be substituted for the heating roller 14.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A belt-type fixing device, comprising:

an endless sheet-like fixing belt to be heated wound around a supporting member and around a one-piece nip forming member that is fixed in a position away from the supporting member so as to be incapable of rotating, and a pressurizing roller which can be driven to rotate, which is in pressure contact with the nip forming member with the fixing belt interposed between, and of which part in contact with the fixing belt forms a fixing nip, wherein a surface of the one-piece nip forming member that is opposite to the pressurizing roller is configured as a curved surface extending along an outer circumferential surface of the pressurizing roller so that a pressure distribution in the fixing nip is made generally flat with respect to a paper feeding direction, the fixing belt is rotated while being slid on the nip forming member by rotational drive of the pressurizing roller, and a contact area between the fixing belt and the one-piece nip forming member outside the fixing nip is smaller on an entrance side of the fixing nip than on an exit side of the fixing nip.

2. A belt-type fixing device as claimed in claim 1, wherein the supporting member is a rotatable heating roller and an outside diameter of the heating roller is larger than a width of the nip forming member with respect to the paper feeding direction.

3. A belt-type fixing device as claimed in claim 2, wherein the heating roller is in a position lower than the nip forming member, in a configuration in which a recording medium is vertically passed through the fixing nip.

4. A belt-type fixing device as claimed in claim 1, wherein an angle which a pre-fixation guide for guiding introduction of a recording medium into the fixing nip forms with the fixing belt on the entrance side of the fixing nip is in a range from 30° to 70°.

5. A belt-type fixing device as claimed in claim 1, wherein a distance between a pre-fixation guide for guiding introduction of a recording medium into the fixing nip and a line extending in parallel with the pre-fixation guide from a point of contact between the nip forming member and the fixing belt on the entrance side of the fixing nip is not less than 3 mm.

6. A belt-type fixing device for fixing a toner image on a paper, the belt-type fixing device comprising:

an endless-sheet-like belt member wound around a heating roller having a heater and around a one-piece nip forming member that is fixed so as to be incapable of rotating, and a pressurizing roller which has an elasticity, which is driven to rotate, which is relatively pressed against the one-piece nip forming member through the belt member, and on which the paper is passed through a fixing nip that is contact part between the pressurizing roller and the belt member, wherein a position of the heating roller is on upstream side relative to the one-piece nip forming member with respect to a direction in which the paper being passed through the fixing nip is conveyed, and a contact area between the belt member and the one-piece nip forming member outside the fixing nip is smaller on an entrance side of the fixing nip than on an exit side of the fixing nip.

7. A belt-type fixing device as claimed in claim 6, wherein a surface of the nip forming member that is opposite to the pressurizing roller has a shape extending along an outer circumferential surface of the pressurizing roller.

* * * * *